United States Patent [19]

Brožková et al.

[11] 4,050,226

[45] Sept. 27, 1977

[54] APPARATUS FOR TIMING A SPINNING-IN OPERATION OF A TEXTILE MACHINE

[75] Inventors: Marie Brožková; František Buryšek, both of Usti nad Orlici; Jan Janoušek, Brandys nad Orlici; Karel Mikulecký, Chocen; Stanislav Škoda, Usti nad Orlici, all of Czechoslovakia

[73] Assignee: Vyzkumny ustav bavlnarsky, Usti nad Orlici, Czechoslovakia

[21] Appl. No.: 730,593

[22] Filed: Oct. 7, 1976

[30] Foreign Application Priority Data

Oct. 7, 1975 Czechoslovakia ..... 6777/75

[51] Int. Cl.[2] ..... D01H 15/00

[52] U.S. Cl. ..... 57/34 R; 57/156

[58] Field of Search ..... 57/34 R, 58.89, 81, 57/156

[56] References Cited

U.S. PATENT DOCUMENTS

| | | | |
|---|---|---|---|
| 3,541,774 | 11/1970 | Sterba et al. | 57/58.89 X |
| 3,803,823 | 4/1974 | Niestroz et al. | 57/34 R |
| 3,882,663 | 5/1975 | Soukup et al. | 57/34 R |

*Primary Examiner*—Richard C. Queisser
*Assistant Examiner*—Charles Gorenstein

[57] ABSTRACT

An arrangement for timing the initiation of a spinning-in operation of an open-end textile machine is described. A sequencer is coupled to the take-up bobbin to provide an indication proportional to the increase in diameter of the yarn package during the take-up operation. The sequencer converts changes in such indication to a variable delay of signals to be applied to at least the take-up rollers and yarn-distributing rollers of the machine. The thus-delayed signals, whose delay is continually updated as the diameter of the yarn package increases, are applied to the appropriate rollers upon the detection of yarn breakage or other suitable initiation signal for the spinning-in mode.

6 Claims, 5 Drawing Figures

APPARATUS FOR TIMING A SPINNING-IN OPERATION OF A TEXTILE MACHINE

BACKGROUND OF THE INVENTION

The invention relates to open-end, ringless weaving machines, and more particularly to arrangements in such machines for initiating a spinning-in procedure upon the occurrence of a yarn breakage or similar malfunction.

In machines of the contemplated type, a set of draw-off rollers are provided for withdrawing spun yarn from the spinning chamber. The yarn is then routed to a traversing distributing roller, which distributes the spun yarn in roving fashion across a take-up bobbin to yield a yarn package thereon whose diameter increases in proportion to the quantity of withdrawn yarn.

Upon the occurrence of yarn breakage or other malfunction, it has been conventional to initiate a spinning-in process whereby the direction of rotation of the draw-off and distributing rollers are reversed. This is provided for by generating a set of adjustment signals, which are respectively applied to the appropriate rollers in timed rotation upon the sensing of the yarn breakage.

The timing relationship between the sensing of the yarn breakage condition and the initiation of the adjustment signals has in the past been chosen in accordance with the characteristic of the spun yarn itself, e.g., its count twist number.

Unfortunately, the dependency of the various delays in the adjustment signals on the characteristics of the yarn do not solve a possibly even more important problem, i.e., the dependency of an optimum spinning-in operation on changes in the diameter of the yarn package on the take-up bobbin as the winding operation proceeds. As a result, the initiation of the spinning-in operation has been adversely effected because of significant changes in friction between the bobbin and the traversing distributing roller as the yarn package builds up on the bobbin. In addition, the initiation of the spinning-in operation has suffered because of changes in the moment of inertia and other dynamic effects of the rollers and bobbin as the yarn package diameter increases.

SUMMARY OF THE INVENTION

Such disadvantages are overcome in accordance with the invention by the provision of an improved system for controlling the initiation of the spinning-in process by the appropriate timing of the adjustment signals for the take-up and distributing rollers. Generally, such facilities are adapted to vary the timing and delay of the respective adjustment signals in proportion to the then-occurring diameter of the yarn package on the take-up bobbin. As so generated, the adjustment signals are switched into the respective rollers upon the detection of a spinning-in initiation condition, e.g., yarn breakage.

In an illustrative embodiment, the adjustment signals are generated with the use of a first stepping switch advanced in proportion to an electrical indication, which is derived from a sensing means in contact with the bobbin and which varies such signal in accordance with the increase in diameter of the yarn package.

A second stepping switch is associated with the first switch, and is driven at a constant rate significantly greater than the rate of advance of the first switch. The various angular positions of the first and second switches are so correlated that upon a coincidence of the position of the contact arm of the second switch with that of the first switch, the first of the adjustment signals is generated with a delay proportional to the angular distance between a reference position of the two switches and the position of correspondence of the contact arms.

In one feature of the invention, the sensed indication corresponding in magnitude to the diameter of the yarn package is derived by coupling the bobbin removably to a pivotal arm, and sensing the movement of the arm relative to an angularly fixed point (e.g., the distributing roller frictionally coupled to the take-up bobbin) as the yarn builds up on the bobbin. In such case, the electrical indication is proportional to the degree of movement of the pivotal arm. Alternatively, a gear sector may be mounted on the pivotal arm, and a pinion, cooperable with the gear sector, is rotated by the gear sector as the pivotal arm moves. The rotation of the pinion, in turn, is converted to a proportional electrical indication for advancing the appropriate stepping switch.

The invention is further set forth in the following detailed description taken in conjunction with the appended drawings, in which.

Figure 1:
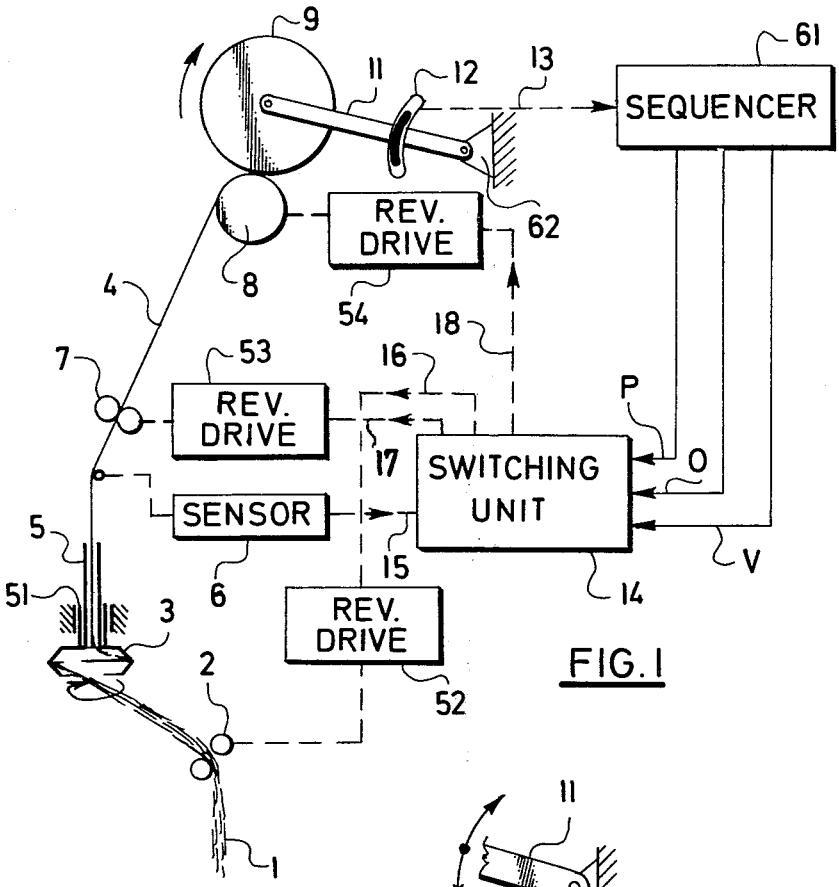
FIG. 1 is a schematic representation of the yarn-withdrawing and take-up portions of an open-end spinning machine, together with a first embodiment of an apparatus for varying the time of application of adjustment signals to the take-up and distributing rollers of the machine in accordance with changes in the diameter of the yarn package wound on the bobbin.
Figure 5:
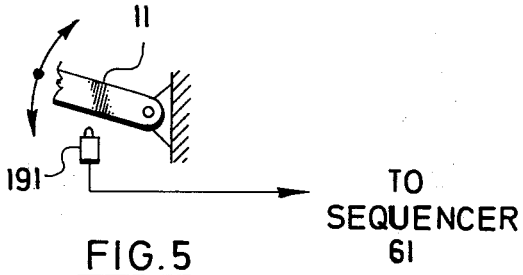
Figure 4:
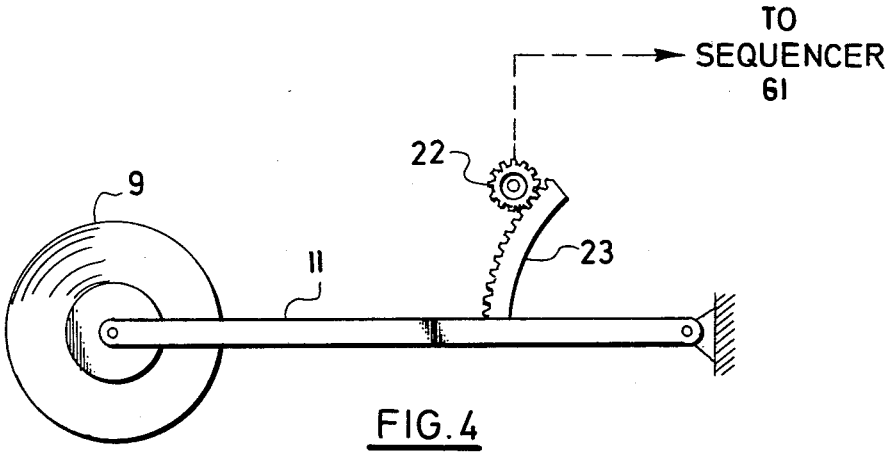
Figures 2, 3:
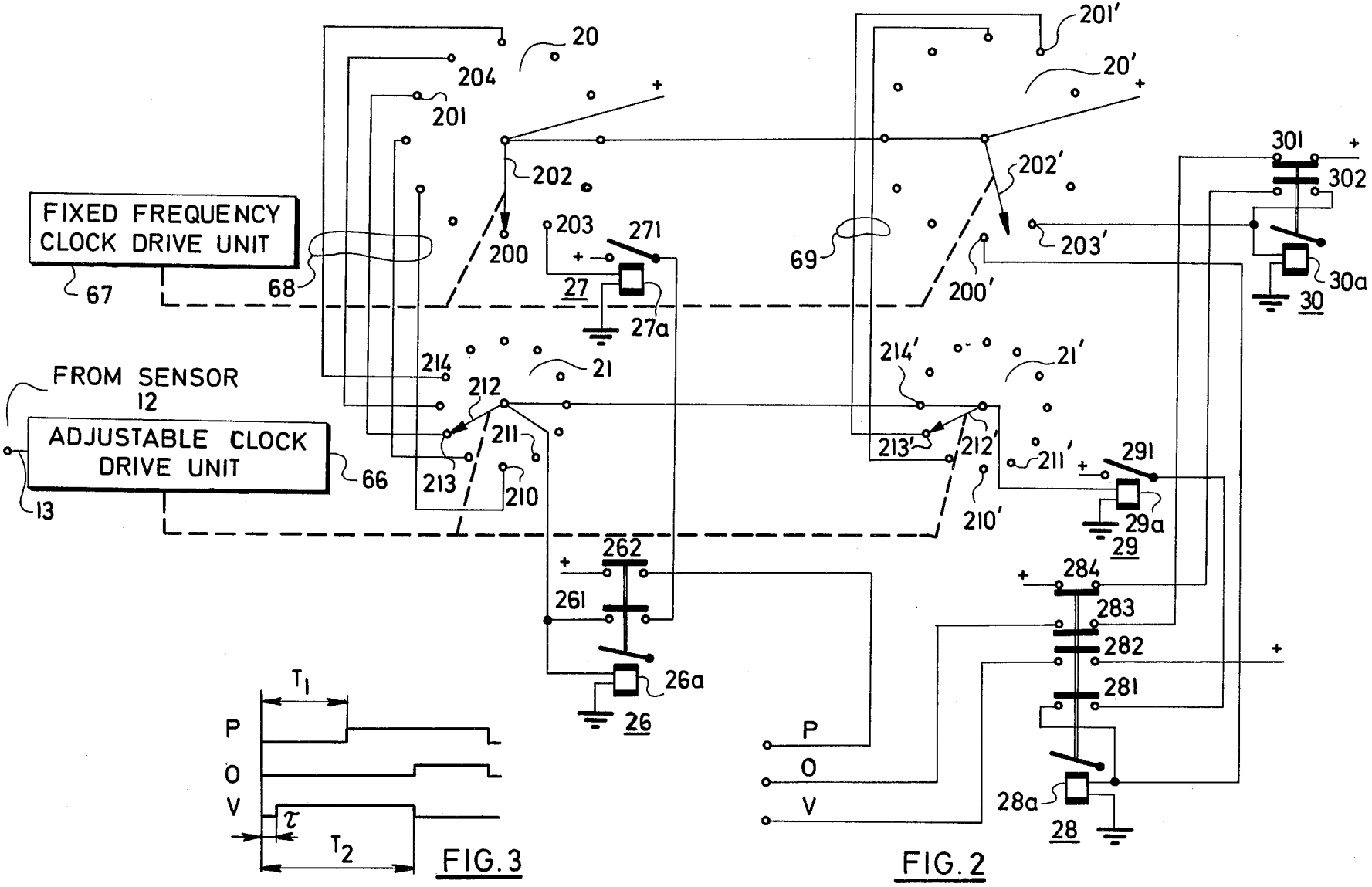
FIG. 2 is a schematic representation of a sequencing arrangement suitable for use in the apparatus of FIG. 1.
FIG. 3 is a set of timing diagrams illustrating relationships between the roller adjustment signals at the output of the sequencer of FIG. 2.

FIG. 4 is a schematic representation of a bobbin and a pivotal arm similar to corresponding components of FIG. 1, but associated with an alternative embodiment of a mechanism for converting increments in diameter of the wound package to an indication suitable for use in the sequencer of FIG. 2; and FIG. 5 is a fragmentary view of a pivotal arm for carrying the bobbin of FIG. 1 with a microswitch for periodically initiating the generation of a pre-programmed, monotonically increasing control signal for operating the sequencer of FIG. 2.

DETAILED DESCRIPTION

Referring now to the drawing, a yarn withdrawing and take-up portion of a ringless or open-end spinning machine is depicted in schematic form. A sliver 1 is advanced via a pair of rollers 2 into a spinning chamber 3, through the intermediary of a combing section and air duct (not shown). The spinning chamber 3 is supported for rotation in bearings 51, and terminates at its upper end in a delivery tube 5 through which the spun yarn may be withdrawn. A variable drive 52 is provided for operating the rollers 2.

A pair of draw-off rollers 7 are disposed upstream of the withdrawal tube 5. The rollers 7, which are operated via a variable drive 53, are effective to advance the spun yarn withdrawn from the tube 5 to a conventional traversing-type distributing roller 8, whose periphery is in frictional engagement with a take-up bobbin 9. The roller 8 is provided with suitable grooves (not shown) which, during the traverse of the roller 8 while the latter is in frictional engagement with the bobbin 9 will be effective to wind the spun yarn in roving fashion around the bobbin 9 to form a finished yarn package. The distributing roller 8 is operable by means of a variable drive 54.

A breakage detector 6 is disposed in the path of the withdrawn yarn between the tube 5 and the rollers 10 for out-pulsing, on a line 15, an electrical indication upon the detection of a yarn breakage. Such electrical indication is applied to an excitation input of a switching unit 14, which is adapted to apply, to the respective variable drives 52, 53 and 54, suitably timed pulses for adjusting the associated rollers into "spinning-in operation." As is well known, such mode of operation is effected by the reversal of rotation of the associated rollers. For this purpose, and in accordance with the invention, the switching unit 14 responds to the trigger signal on line 15 to couple actuation signals from a sequencer 61 to the respective drives 52, 53 and 54 over lines 16, 17 and 18, respectively.

The adjustment signals, which may respectively take the form illustrated in the timing diagrams of FIG. 3, are interrelated in time, with the signal on the line 16 being delayed by a selectable interval $T_1$ relative to a reference interval, and with the other signals on the lines 17 and 18 being generated in timed relation to the signal on line 16.

Conventionally, the delays of the signals on lines 16, 17 and 18 relative to the reference interval, and particularly with respect to the instant of application of the first indication from the yarn breakage indicator 6 to the switching unit 14, was made adjustable in accordance with a parameter of the yarn, e.g., the yarn count. In accordance with the invention, an improved characteristic of the spinning-in operation initiated by the indication on the line 15 is obtained by providing for a variation of the delay $T_1$ (FIG. 3) of the adjustment signal on line 16, and thereby the delay of the adjustment signals on lines 17 and 18, respectively, in proportion to the size of the yarn package which has been accumulated until that time on the take-up bobbin 9. Stated another way, the sequencer 61 is made responsive to the successive increase in the diameter of the yarn package on the bobbin 9 to continually update the delay characteristics on the three output lines extending therefrom to the switching unit 14. With such arrangement, the gating of the switching unit 14 by the output indication on the line 15 will cause the rollers 2, 7 and 8 to be reversed with the required delay that has been found optimum for the then-occurring diameter of yarn package on the bobbin 9.

In the particular arrangement shown in FIG. 1, variations in overall diameter of the yarn package are sensed by an arrangement that includes an arm 11 pivoted at one end as at 62, and removably secured at its outer end to the bobbin 9. Since the distributing roller will remain in the same horizontal plane as viewed in FIG. 1, a build up of yarn on the bobbin 9 will cause the arm 11 to be progressively rotated in a clockwise direction about the pivot point 62.

A suitable motion sensor 12 is adapted to generate a second output indication on a line 13, such indication being proportional to the degree of clockwise movement of the arm 11 from a reference position, which may conveniently be the position at which no yarn has been wound on the bobbin 9; more particularly, the reference position will correspond to the position of the arm 11 when an empty bobbin is substituted for a full bobbin during the operation of tye unit depicted in FIG. 1.

The monotonically increasing signal on the line 13 during the build up of the yarn package on the bobbin 9 is applied to an input of the sequencer 61. As will be explained in more detail in connection with FIG. 2, such increments of amplitude of the signal on line 13 are converted to variations in phase of the delayed time $T_1$ of the roller adjustment signal on a first output line (designated "P") of the sequencer 13, which in turn will establish corresponding phase delays on the other output lines (designated "O" and "V," respectively) at the output of the sequencer. As indicated before, the adjustment signals P, O and V are continually updated as the yarn package diameter increases, and upon the gating of the switching unit 14 the latest update of such signals are applied, with the proper phase, to the associated roller drives 52, 53 and 54.

FIG. 2 illustrates one embodiment of the sequencer 61. The electrical indication from the position sensor 12, which increases monotonically in amplitude as the diameter of the wound package on the bobbin 9 (FIG. 1) increases, is converted to a variable clock signal of proportional frequency in an adjustable clock drive unit 66. The output of the drive unit 66 is coupled in ganged fashion to respective contact arms 212, 212' of a first pair of stepping switches 21, 21'. The sequencer further includes a fixed-frequency clock drive unit 67, which is coupled in ganged fashion to respective contact arms 202, 202' of a second pair of stepping switches 20, 20'. Illustratively, the drive unit 67 is so adjusted as to rotate the contact arms 202, 202' at a reference rate of about one revolution per second.

The adjustable clock drive unit 66, on the other hand, is adapted to rotate the associated contact arms 212, 212' with a variable frequency which may be instantaneously proportional to the signal from the sensor 12 and which in any event is significantly lower than the rate of rotation of the contact arms 202, 202'. As a result, it may be assumed that the position of the contact arms 212, 212' remain substantially constant during a typical revolution of the arms 202, 202'. A plurality of contact points on the periphery of the switches 20, 21 are associated by a plurality of conductors 68 extending therebetween. For example, a point 213 on the periphery of the switch 21 is conductively connected to a contact 201 on the periphery of the switch 20.

In like manner, the several contact points on the periphery of the switch 21' are associated, via conductors 69, with a plurality of contact points around the periphery of the switch 20'. For example, the indicated contact 213' of the switch 21' is conductively connected to the contact 201' of the switch 20; as noted, corresponding contact points around the peripheries of the switches 21, 21' are connected to non-corresponding contact points around the peripheries of the switches 20, 20'. The contact point 200 at the bottom dead center position of the switch 20 may be considered a reference "O" timing point for purposes of the diagrams of FIG. 3, for purposes of establishing the variable delay $T_1$ of the signal P as indicated below.

The absolute value of the stepping speed of the contact arms 212, 212' may be so chosen that, for an average build up of yarn package on a bobbin, the bottom dead center contacts 210, 210' represent an empty bobbin position, while the contact points 211, 211', attained by the arms 212, 212' after almost a complete revolution thereof, represents the full bobbin condition.

As will be seen, a progressive increase in the angular advance of the contact arm 212 will, during successive cycles of rotation of the contact arm 202, result in the generation of repetitive adjustment pulses P (FIG. 3) whose delay $T_1$ from the reference position will correspondingly, progressively increase.

The contact arms 202, 202' of the switches 20, 20' are connected to a grounded source of voltage represented by a plus sign. The contact arms 212, 212' are respectively connected to grounded coils 26a, 29a of relays 26 and 29, respectively.

A contact 203, representing the largest increment of advance of the contact arm 202 prior to reaching its reference position 200, is connected to a grounded coil 27a of a relay 27. Similarly, a contact point 203' representing the largest increment of advance of the contact arm 202' prior to reaching the reference point 200' is connected to a grounded coil 30a of a relay 30.

Assume that the adjustable clock drive unit 66 is set to adjust the rate of movement of the contact arms 212, 212' so that at a given yarn package diameter each of the arms 212, 212' are instantaneously opposite the contact 213, 213' upon the constant-speed rotation of the contact arm 202 of the switch 20 from the reference point 200 to the point 201 representing the illustrated delay interval $T_1$ of FIG. 3, a conductive path will be completed from the illustrated voltage source to ground through the contact arm 202, the contact point 201, the associated conductor 68, the contact point 213, the contact arm 212 and the coil 26a. The resultent actuation of the relay 26 will close a normally open set of contacts 262 thereof, thereby coupling a corresponding voltage applied to the left hand terminal of the contacts 262 to the output "P" of the sequencer 61. Such excited coil 26a will remain excited because of lock-up due to the simultaneous closure of a second set of contacts 261 thereof, which in turn will be effective to maintain voltage on the coil 26a through normally open contacts 271 of the still-unexcited relay 27. Consequently, the output P will be maintained irrespective of the continued advance of the contact arm 202 of the switch 20.

When such contact arm 202 has progressed far enough to contact the point 203 on the periphery of the switch 20, a voltage path will be completed to ground through the contact arm 202, the contact point 203 and the coil 27a of the relay 27. The resultant excitation of the relay 27 will open the contacts 271, thereby removing excitation from the coil 26a and disabling the "P" output of the sequencer 61.

During the next cycle of advance of the contact arm 202, the contact arm 212 of the switch 21 will have advanced by an amount proportional to the incremental increase in diameter of the yarn package, as indicated above. Thus, if on such next cycle (or on any succeeding cycle) the contact arm 212 reaches the next-succeeding contact point 214 on the periphery of the switch 21, then the initiation of the leading edge of the next pulse P (FIG. 3) will not occur until the contact arm 202 has reached the contact point 204 conductively associated with the point 214 on the switch 21, thereby representing an instantaneous delay $T_1$ which is greater than the corresponding delay during the previous cycle of the output P; and so on.

The right-hand switches 20' and 21' are utilized to generate the remaining two outputs O and V of the sequencer 61. As noted in FIG. 3, the lower dead center contact 200' of the switch 20' is connected via a conductor 71 to a grounded coil 28a of a relay 28. Thus, each time the arm 202' moves past the reference point 200', the relay 28 operates, thereby closing a normally open set of contacts 282 to provide voltage excitation to the output line V of the sequencer 61.

The angular disposition of the contact arm 202' is slightly behind that of the contact arm 202', so that the initiation of the output V will occur by a corresponding time delay $\tau$ (FIG. 3) relative to the reference instant at which the arm 202 moves past the lower dead center position 200.

The coil 28a once excited, is maintained excited by operation of an associated normally open set of lock-up contacts 281, which couple voltage through a set of normally closed contacts 291 of the now-unoperated relay 29 to the coil 28, so that the initiated voltage V will be maintained even after the contact arm 202' moves past the contact 200'.

In the arrangement shown in FIG. 2, the angular orientation of the contact arm 212' of the switch 21' corresponds to that of the contact arm 212 of the switch 21. In this position, the contact 212' is in engagement with a contact point 213, which is connected via an associated one of the conductors 69 to a contact point 201' of the switch 20'.

When the contact arm 202' has been advanced far enough to contact such point 201', a voltage path will be established to ground through the contact arm 202', the point 201', the conductor 69, the contact point 213', the contact arm 212', and the coil 29a of the relay 29. The resultant excitation of the relay 29 will open the normally closed exciting contacts 291, thereby decoupling excitation from the coil 28a of the relay 28, and re-opening the contacts 282 thereof. At this instant, therefore, the voltage pulse V in the illustrated cycle of the sequencer will be terminated; such termination occurs at a time $T_2$ after the reference instant, as shown in FIG. 3.

The disabling of the coil 28a will restore a pair of normally closed contacts 283 of the relay 28 to their normal state, whereby initiating a voltage pulse O at the output of the sequencer via a path containing the normally closed contacts 301 of the still-unoperated relay 30, and the normally closed contacts 283.

When the contact arm 202' has advanced still further past the contact 201' so that it contacts the point 203', a voltage path to ground will be established through the arm 202', the contact 203' and the coil 30a of the relay 30. As a result, the relay 30 will be excited to open the normally closed contacts 301 and to thereby terminate the voltage pulse O on the output of the sequencer 61.

At the end of each cycle of operation of the sequencer 61 suitable restoring circuitry (not shown) is actuated to bring each of the still-operated relays into its inactive state.

From the foregoing, it will be noted that the delay time $T_1$ of the adjustment signal P and the delay time $T_2$ for the initation of the adjustment signal O will be respectively determined by the degree of advance of the associated contact arms 212, 212' of the switches 21, 21'. Therefore, during successive cycles of the switches 21, 21' wherein such contact arms are incrementally advanced in proportion to the degree of build-up of the yarn on the bobbin 9 (FIG. 1), the then-occurring delays $T_1$, $T_2$ will each increase in proportion.

An alternative form of the sensing element 12 is shown in FIG. 4. The pivotal arm 11 has a gear sector 23 fixedly connected thereto. A pinion 22 is adapted for engagement with the gear sector 23, and will rotate by a degree proportional to the linear movement of the sector 23 as the arm 11 pivots. Such pivotal movement, in turn, will be proportional to the build-up of the diameter of the yarn package on the bobbin 9. If such type of sensor 12 is employed, the adjustable clock drive unit 66 of FIG. 2 may be provided wih suitable facilities for converting the angular movement of the pinion 22 of FIG. 4 to a corresponding stepping rate for the associated contact arms 212, 212' (FIG. 2). The sequencer described in FIG. 2 has been assumed to be of the type that generates the required adjustment signals P, O and V in response to an actual measured variation of diameter of the bobbin 9 then connected to the pivotal arm 11. Alternatively, the sequencer 61 may be embodied as a fixed program control, whose characteristics have been designed to accommodate the changes of diameter of a typical or "average" bobbin. In such case, the input necessary to cycle the sequencer through a repetitive pattern of progressively delayed wave forms of the type shown in FIG. 3 can be restricted to a trigger pulse established by a microswitch 191 (FIG. 5). Preferably, the pivotal arm 11 is adapted to contact the microswitch 191 when the associated bobbin 9 is empty.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a textile machine having a spinning chamber, first draw-off roller means for withdrawing spun yarn from the spinning chamber in a forward advance direction, the first roller means being reversible into a spinning-in mode in response to a first and a second reversing signal, a take-up bobbin, and second distributing roller means disposed in driving relation with the bobbin for receiving withdrawn yarn from the first roller means and for winding the yarn in roving fashion about the bobbin to define a wound yarn package whose diameter increases in proportion to the quantity of the withdrawn yarn, the second roller means being reversible into a corresponding spinning-in mode in response to a first and a second reversing signal, the improvement which comprises, in combination, means responsive to a progressive increase in diameter of the wound package for generating a succession of the first and second reversing signals having progressive delays corresponding to the increase in diameter, sensing means coupled to the machine for providing a first indication upon the occurrence of a yarn breakage condition, and switching means coupled to the output of the generating means and to the sensing means and rendered effective upon the occurrence of the first indication for individually applying the first and second reversing signals to the first and second roller means, respectively.

2. Apparatus as defined in claim 1, further comprising means coupled to the bobbin for producing a second indication increasing in proportion to increases in the diameter of the wound package; and in which the generating means comprises, in combination, a first stepping switch, means coupled to the producing means for advancing the first stepping switch in proportion to increases in the second indication, and means for varying the delay of the first and second reversing signals in proportion to the total advance of the first stepping switch from a reference position.

3. Apparatus as defined in claim 2, in which the generating means further comprises, in combination, a second stepping switch, means for advancing the second stepping switch at a constant rate significantly greater than the rate of advance of the first stepping switch, and means for initiating the first reversing signal when the angular position of the second stepping switch corresponds to the then-attained advance of the fist stepping switch.

4. Apparatus as defined in claim 2, in which the producing means comprises, in combination, a pivotal arm for supporting the bobbin and movable in a first arcuate path by distances proportional to increases in diameter of the wound package, and means coupled to the pivotal arm for providing a signal having an amplitude proportional to the degree of movement of the arm.

5. Apparatus as defined in claim 4, in which the producing means comprises a gear sector secured to the pivotal arm, a pinion cooperable with the gear sector and rotatable in proportion to the movement of the sector, and means for translating the rotation of the pinion into a proportional electrical quantity.

6. A method of initiating a spinning-in mode of an open-end spinning machine upon the detection of a yarn breakage condition, the machine comprising a spinning chamber, first draw-off roller means for normally withdrawing spun yarn from the spinning chamber in a forward advance direction, the first roller means being reversible into a spinning-in mode in response to the occurrence of a first reversing signal, a take-up bobbin, and second distributing roller means disposed in driving relation with the bobbin for receiving withdrawn yarn from the first roller means and for winding the yarn in moving fashion about the bobbin to define a wound yarn package whose diameter increases in proportion to the quantity of the withdrawn yarn, the second roller means being reversible into a corresponding spinning-in mode in response to a second reversing signal, the improvement which comprises the steps of generating a succession of the first and second reversal signals with a progressive delay corresponding to a progressive increase in yarn package diameter during the forward advance of the spun yarn and individually applying the so-delayed first and second reversal signals to the first and second roller means, respectively, upon the detection of a yarn breakage condition.

* * * * *